US008177528B2

(12) United States Patent
Petersen

(10) Patent No.: US 8,177,528 B2
(45) Date of Patent: May 15, 2012

(54) ROTARY POSITIVE DISPLACEMENT PUMP WITH MAGNETIC COUPLING HAVING INTEGRATED COOLING SYSTEM

(75) Inventor: Reinhard Petersen, Ghent (BE)

(73) Assignee: SPX Flow Technology Belgium, Erpe-Mere (BE)

( * ) Notice: Subject to any disclaimer, the term of this patent is extended or adjusted under 35 U.S.C. 154(b) by 456 days.

(21) Appl. No.: 12/445,908

(22) PCT Filed: Oct. 16, 2007

(86) PCT No.: PCT/EP2007/061033

§ 371 (c)(1), (2), (4) Date: Apr. 16, 2009

(87) PCT Pub. No.: WO2008/046828

PCT Pub. Date: Apr. 24, 2008

(65) Prior Publication Data

US 2010/0111742 A1 May 6, 2010

(30) Foreign Application Priority Data

Oct. 17, 2006 (WO) ..... PCT/EP2006/010013

(51) Int. Cl.
*F04B 17/00* (2006.01)

(52) U.S. Cl. ..... 417/410.1

(58) Field of Classification Search ..... 417/411–412, 417/410.1

See application file for complete search history.

(56) References Cited

U.S. PATENT DOCUMENTS

| | | | | |
|---|---|---|---|---|
| 3,370,540 | A | 2/1968 | Carpenter | |
| 7,001,063 | B1 * | 2/2006 | Markle | 366/168.1 |

FOREIGN PATENT DOCUMENTS

| | | |
|---|---|---|
| DE | 40 09 199 | 9/1991 |
| EP | 0 555 173 | 8/1993 |
| EP | 0 590 777 | 4/1994 |
| WO | WO 00/29730 | 5/2000 |

OTHER PUBLICATIONS

International Search Report dated Mar. 13, 2008.

* cited by examiner

*Primary Examiner* — Toan Ton
*Assistant Examiner* — Hana Featherly
(74) *Attorney, Agent, or Firm* — Baker & Hostetler LLP

(57) ABSTRACT

A rotary positive displacement pump for liquid medium having a main pumping mechanism driven by a magnetic coupling is disclosed. The positive displacement pump includes an integrated, positive displacement, circulating pump configured to provide a controlled medium flow through the magnetic coupling from a discharge side (0206) of the main pump back to a suction side (0205) of the main pump.

12 Claims, 8 Drawing Sheets

Figures 1, 1A:
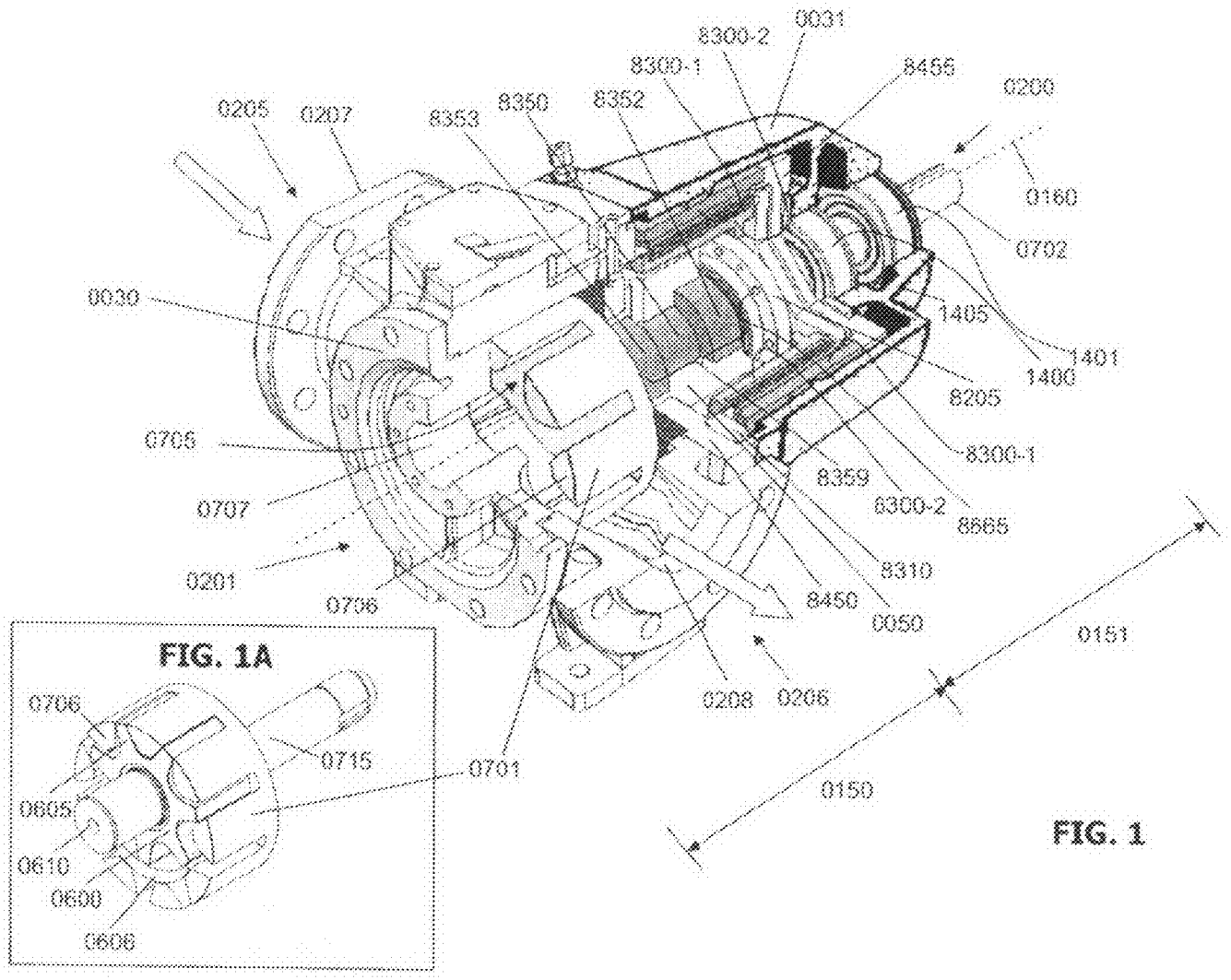

ROTARY POSITIVE DISPLACEMENT PUMP WITH MAGNETIC COUPLING HAVING INTEGRATED COOLING SYSTEM

CROSS-REFERENCE TO RELATED APPLICATIONS

This application is the U.S. National Phase under 35 U.S.C. §371 of International Application PCT/EP2007/061033, filed Oct. 16, 2007, which claims priority to PCT/EP2006/010013, filed Oct. 17, 2006.

FIELD OF THE INVENTION

The invention relates to a rotary, magnetically coupled positive displacement pump, in particular a magnetically coupled gear pump, which pump incorporates a separate positive displacement pump to provide a continuous flow of cooling through the bearings and magnetic coupling. This cooling system works independently of the differential pressure over the main pump and the viscosity of the pumped medium.

BACKGROUND TO THE INVENTION

Rotary positive displacement pumps are based on the concept a rotating element that mechanically transports a volume of medium from a suction (inlet) end of the pump to the discharge (outlet) end during a revolution. A single revolution displaces a fixed volume of liquid, regardless of its viscosity. Typical examples of positive displacement pumps are internal gear pumps, external gear pumps, and rotary vane pumps. When a positive displacement pump is magnetically driven, the rotating elements can be incorporated into a hermetically sealed chamber, to avoid leakage of the pump medium during normal operation and in the event of pump failure. The combination of magnetic coupling and positive displacement suit the use of such pumps for pumping liquids, such as toxic media, chemicals, inflammable liquids, etc. where it is required or desirable to have a completely leak proof pump.

Partly due to eddy currents in the magnetic coupling caused by the rotation of the permanent magnet and partly because of bearing and hydraulic losses the magnetic coupling may get inadmissibly hot, so that cooling becomes necessary. This is obtained in known constructions by using the pressure drop across the pump to conduct a part of the pump medium through the coupling and bearings. This entails some disadvantages, however, in particular because the viscosities of the pump media are in themselves different, they are temperature dependent, and furthermore the pressure drop across the pump varies, so that there is no control of the rate of flow for cooling. This means that the cooling of the magnetic coupling and bearings has to be individually adapted to the specific pump medium and its temperature. The leakage of pump medium for cooling purposes means a reduced pump capacity.

The purpose of the invention is to provide an efficient cooling of the magnetic coupling and bearings of a positive displacement pump. Furthermore it is a purpose of the cooling system that there is no excessive internal leakage in the pump.

If the differential pressure of the pump is used to drive the cooling flow through the magnetic coupling, a problem occurs when pumping a high viscous medium while the pressure difference between suction and discharge port of the pump is relatively low. In this situation the flow through the coupling might become too small to guarantee the proper cooling of the coupling. Furthermore, if the viscosity of the pumped medium changes during pumping, the flow across the coupling would change as well, meaning cycles of excessive or insufficient cooling would be set up within the pump.

An aim present invention is to provide an improved internal gear pump having a cooling system that overcomes overheating experienced in the art.

SUMMARY OF SOME EMBODIMENTS OF THE INVENTION

One embodiment of the invention is a pump for liquid medium, comprising:

- a pump casing containing:
  - a forward (0201) pumping section (0150) having an inlet (0207) and an outlet (0208), and
  - a rearward (0200) magnetic coupling section (0151) having an inner magnetic rotor (8300-2) and outer magnetic rotor (8300-1) separated by a separation can (8310), which outer magnetic rotor (8300-1) transmits rotation via magnetic coupling to the inner magnetic rotor (8300-2),
- a main pump in the pumping section (0150) that is a rotary positive displacement pump that provides suction through the inlet (0207) and discharges through the outlet (0208),
- whereby the main pump is mechanically connected to a rotor shaft (0715) mounted in a plane bearing (8359), which shaft (0715) is connected to the inner magnetic rotor (8300-2), and
- a circulation pump in the pumping section (0150) configured to cool the plane bearing and magnetic coupling, wherein the circulation pump is a rotary positive displacement pump mechanically connected to said rotor shaft (0715).

Another embodiment of the invention is a pump as described above, wherein the circulation pump comprises an inlet port (1010) connected to the outlet (0208) of the main pump via a liquid-conducting passage.

Another embodiment of the invention is a pump as described above, wherein the casing comprises a plurality of liquid-conducting passages for conducting medium to the plane bearing (8359) and inner magnetic rotor (8300-2), and whereby an outlet (1016) of the circulation pump is connected to said conducting passages.

Another embodiment of the invention is a pump as described above, wherein the main pump and the circulation pumps are gear pumps.

Another embodiment of the invention is a pump as described above, wherein the main gear pump comprises a rotor (0701) and an idler (0600), whereby the rotor (0701) is mechanically connected to the rotor shaft (0715).

Another embodiment of the invention is a pump as described above, wherein the circulation gear pump comprises a rotor (8420) and a drive gear (8410), whereby the drive gear (8410) is mechanically connected to the rotor shaft (0715).

Another embodiment of the invention is a pump as described above, wherein the axes of rotation of the main pump rotor (0701), the circulation pump drive gear (8410), the inner magnetic coupling, and the rotor shaft are coaxial.

Another embodiment of the invention is a pump as described above, further comprising:

- a rearward annular passageway, RAP, (8610) concentrically arranged over a rearward end (0200) of the plane bearing (8359) and whereby a forward face of the hub (8205) of the inner magnetic rotor (8300-2) forms a boundary surface of the RAP (8610), a concentric ring chamber (8660) connects the RAP (8610) with the rearward end (0200) of the plane bearing (8359), a longitudinal supply passage (8600) in the casing running from outlet (1016) of the circulation pump towards said hub (8205), whereby the longitudinal supply passage (8600) opens into said (RAP), and a plurality of apertures (8865) in said hub (8205) running in a longitudinal direction from the forward to the rearward face of the hub (8205), said arrangement allowing medium from the outlet (1016) of the circulation pump to flow across the plane bearing (8359) and across a gap (8620) between the separation can (0310) and inner magnetic rotor (8300-2).

Another embodiment of the invention is a pump as described above, wherein the plane bearing (8359) comprises a shaft sleeve (8350) in connection with the shaft (0715), supported by two bearing bushes (8354, 8355) flanked by two axial bearing rings (8352, 8353), the concentric ring chamber (8660) connects the RAP (8610) with the interface between a rearward (0200) bearing bush (8354) and a rearward (0200) axial bearing ring (8352).

Another embodiment of the invention is a pump as described above, further comprising, a forward annular passageway, FAP, (8640) concentrically arranged over a central section of the plane bearing (8359) and whereby a front (0201) end of the inner magnetic rotor (8300-2) forms a boundary surface of the FAP (8640), and one or more radial passages (8625) connect the FAP (8640) with the central section of the plane bearing (8359), a longitudinal exit passage (8650) in the casing running from the FAP to the inlet (0207) of the main pump (0208), said arrangement allowing medium returning from the plane bearing (8359) and from the gap (8620) between the separation can (0310) and inner magnetic rotor (8300-2) to exit via the inlet (0207) of the main pump (0208).

Another embodiment of the invention is a pump as described above, further comprising a diversion passage (8615) in the casing that connects the outlet port (0206) of the main pump with the forward end (0201) of the plane bearing (8359), said passage allowing medium to flow from the outlet port (0206) of the main pump to flow across the from the plane bearing (8359) and to exit via the FAP (8640).

Another embodiment of the invention is a pump as described above, further comprising a forward concentric ring chamber (8670) that connects the diversion passage (8615) with the forward end (0201) of the plane bearing (8359).

Another embodiment of the invention is a pump as described above, wherein the plane bearing (8359) comprises a shaft sleeve (8350) in connection with the shaft (0715), supported by two bearing bushes (8354, 8355) flanked by two axial bearing rings (8352, 8353), the concentric ring chamber (8670) connects the diversion passage (8615) with the interface between a forward (0201) bearing bush (8355) and a forward axial bearing ring (8353).

Another embodiment of the invention is gear pump for liquid medium having a main pumping mechanism comprising a rotor (0701) and an idler (0600), whereby the rotor (0701) is driven by a magnetic coupling, said gear pump further comprising an integrated, positive displacement, circulating pump configured to provide a controlled medium flow through the magnetic coupling from a discharge side (0206) of the main pump back to a suction side (0205) of the main pump.

Another embodiment of the invention as defined above, wherein said circulating pump is a gear pump comprising a drive gear (8410) and a disk rotor (8420), whereby the central axis of the drive gear (8410) is connected to the central axis of the rotor (0701).

Another embodiment of the invention as defined above, wherein an inlet side (1010) of said circulating pump is connected to a chamber (0105) of the discharge side of the main pump, and an outlet of the circulating pump is connected, via channels in the magnetic coupling, to a chamber (0115) of the suction side of the main pump.

FIGURE LEGENDS

FIG. 1: Three dimensional view of an embodiment of a pump of the invention including a cut away section, shown from the point of view of the main pump components.

FIG. 1A: Three dimensional view of an embodiment of the main pump components including rotor and idler.

Figure 2:
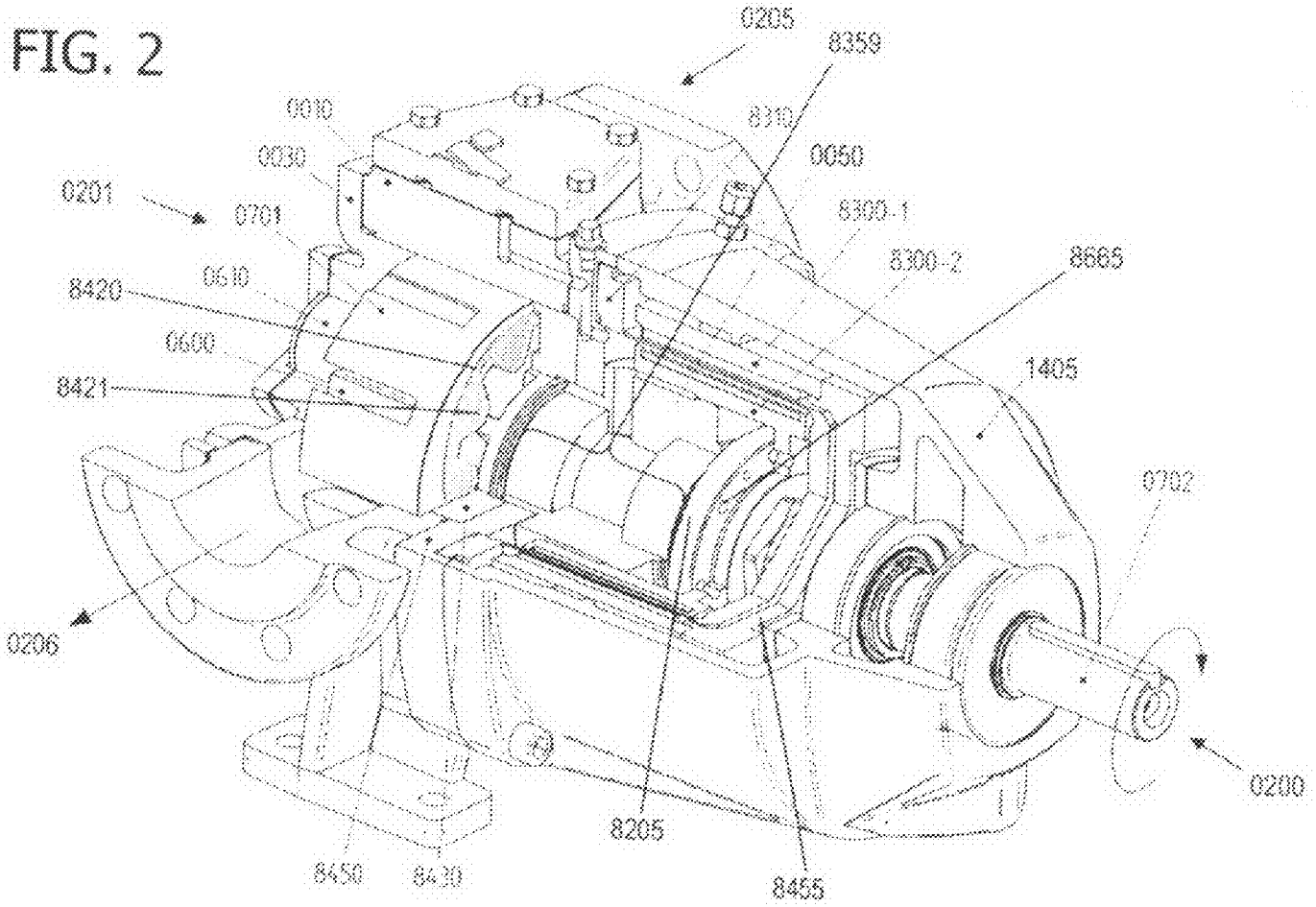

FIG. 2: Three dimensional view of an embodiment of a pump of the invention including a cut away section, shown from the point of view of the circulation pump.

Figure 3:
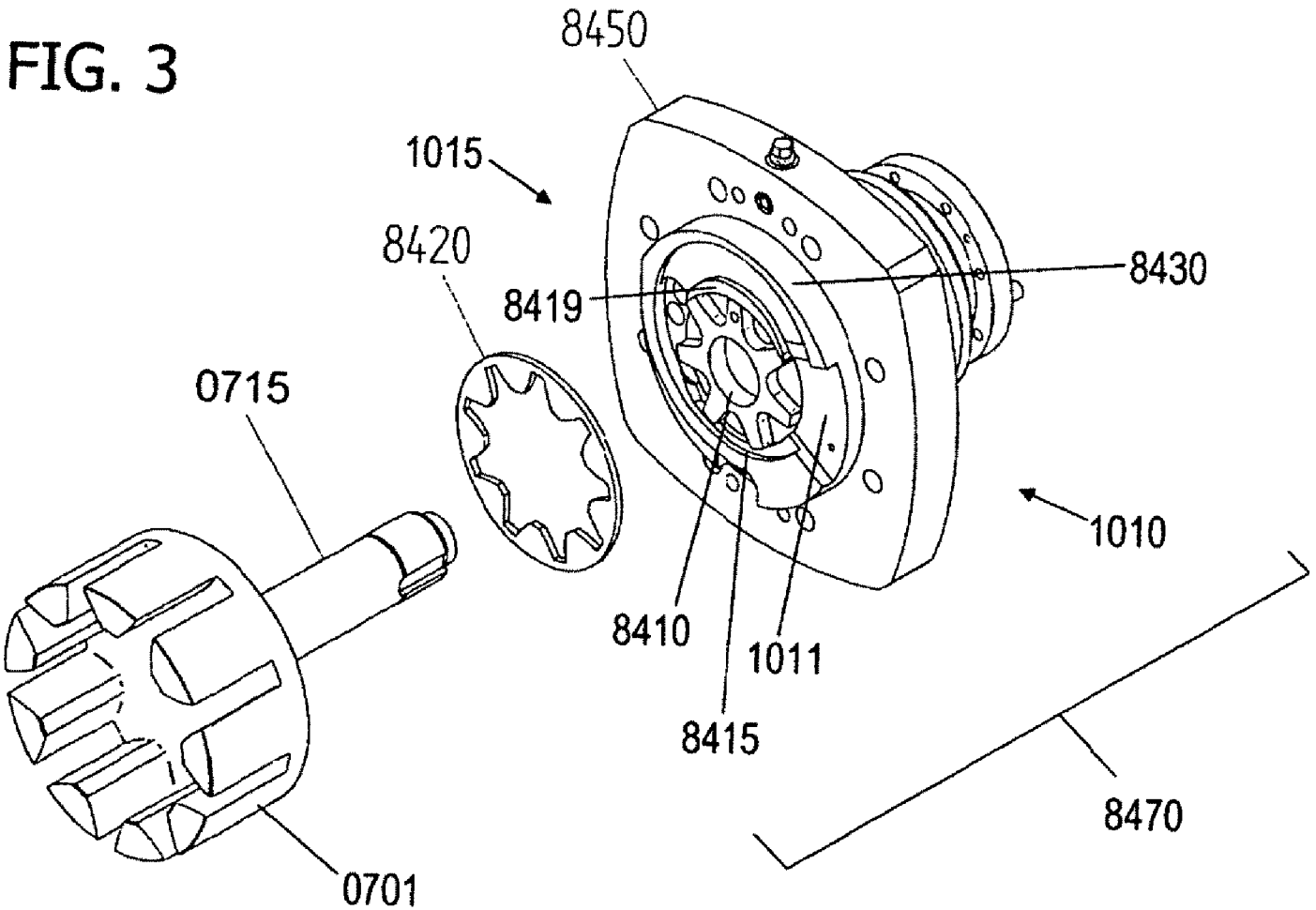

FIG. 3: Three dimensional exploded view of pumping elements presenting an embodiment of the invention. Shown are a rotor and gear present in the circulation pump, and housed in a casing, and a rotor of the main pump.

Figure 4:
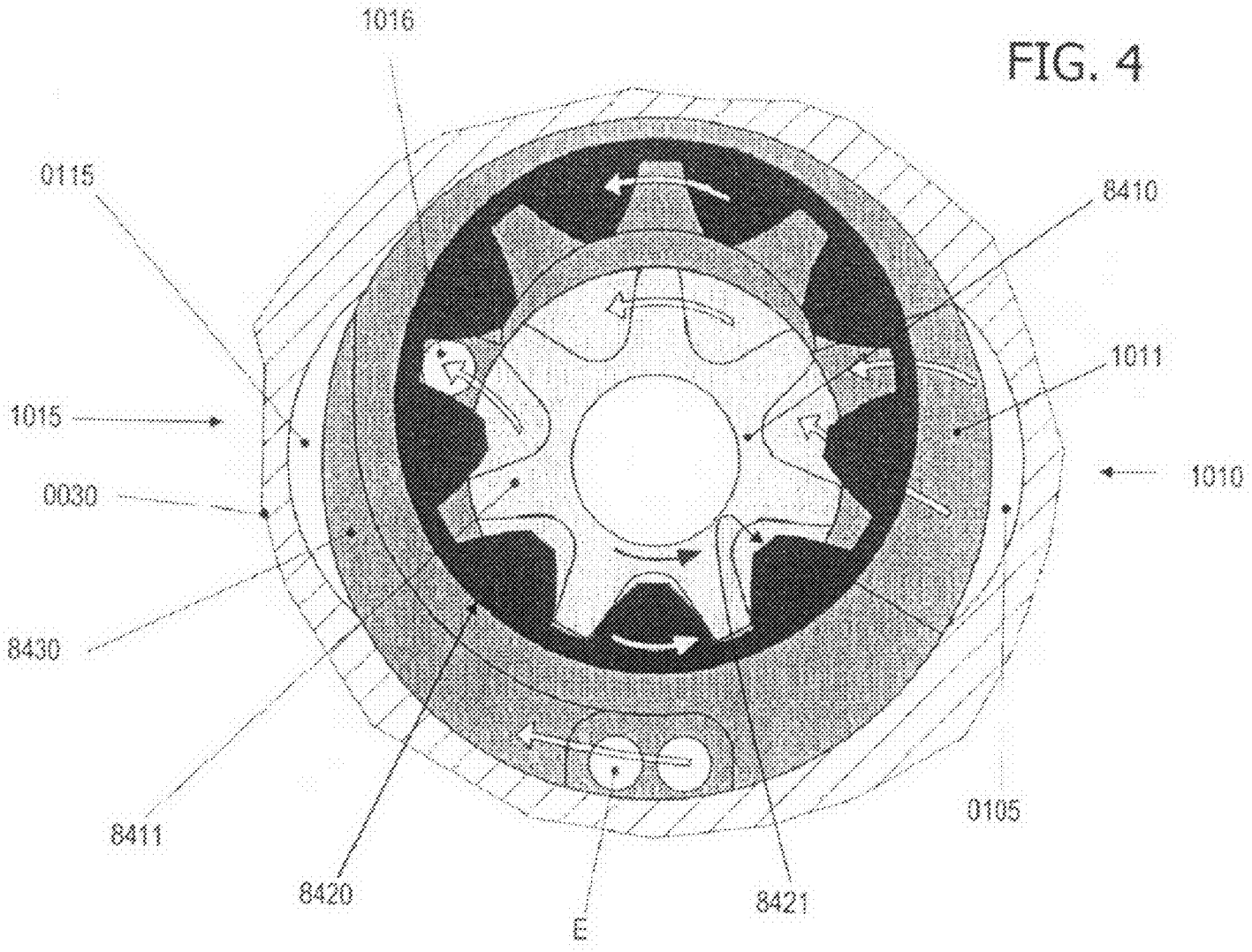

FIG. 4: An end-on view of the elements of the circulation pump, from the front of the pump.

Figure 5:
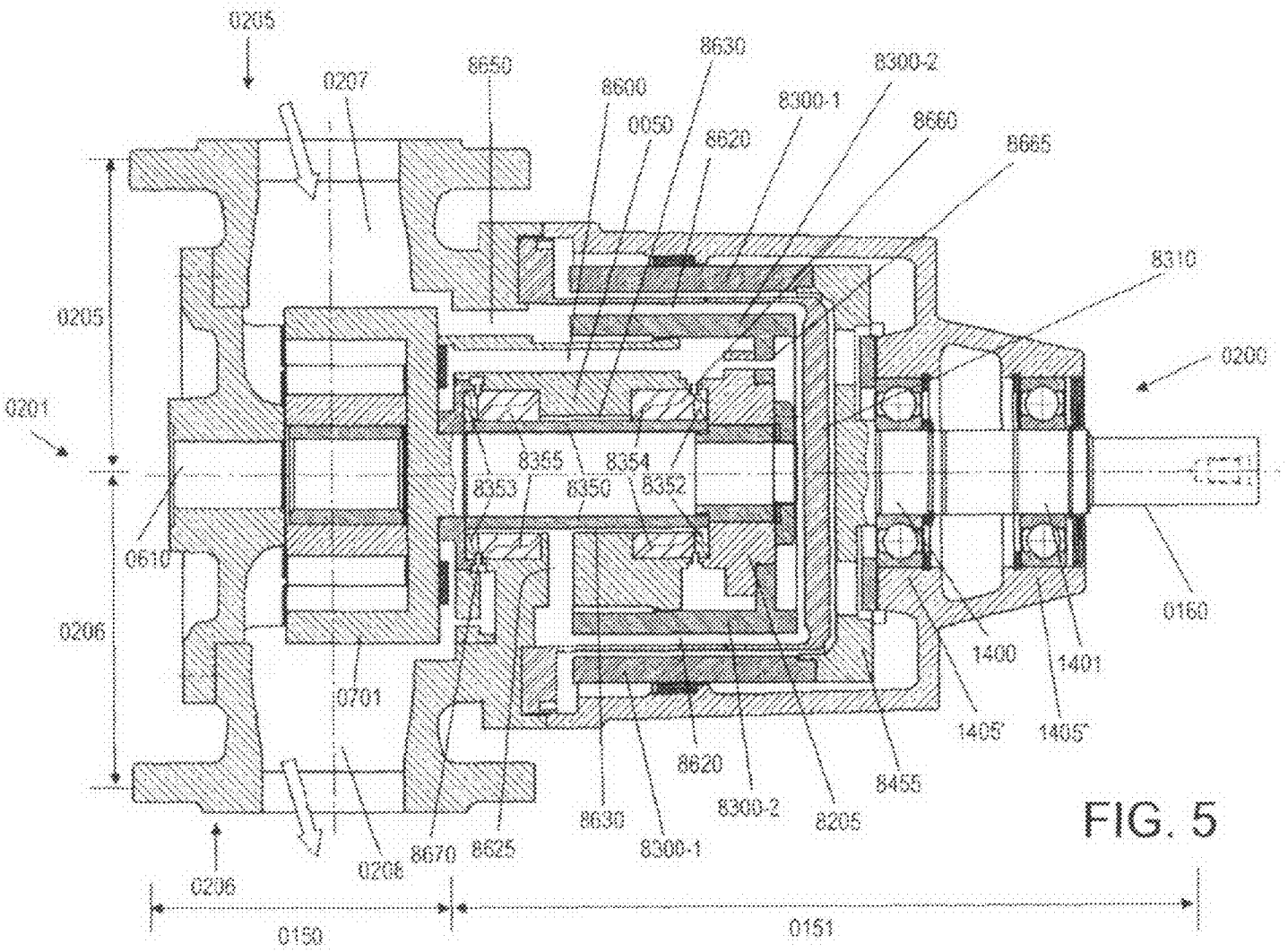

FIG. 5: A cross-sectional view of an embodiment of a pump of the invention, taken along a plane defined by the shaft, and the main inlet and outlet.

Figure 6:
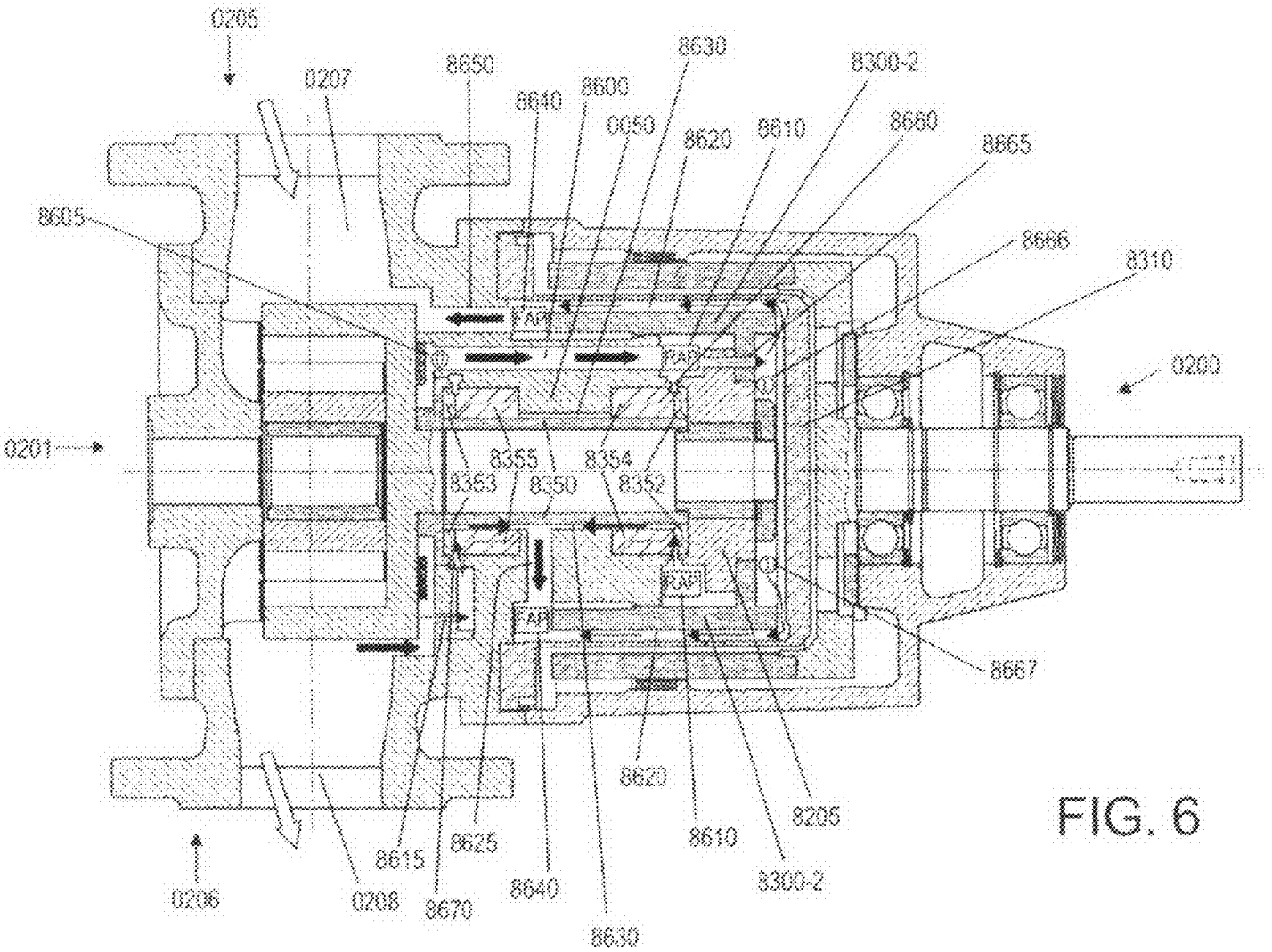

FIG. 6: A cross-sectional view of an embodiment of a pump of the invention as in FIG. 5 onto which the flow of pumped medium through the bearings and magnetic coupling is indicated.

Figure 7:
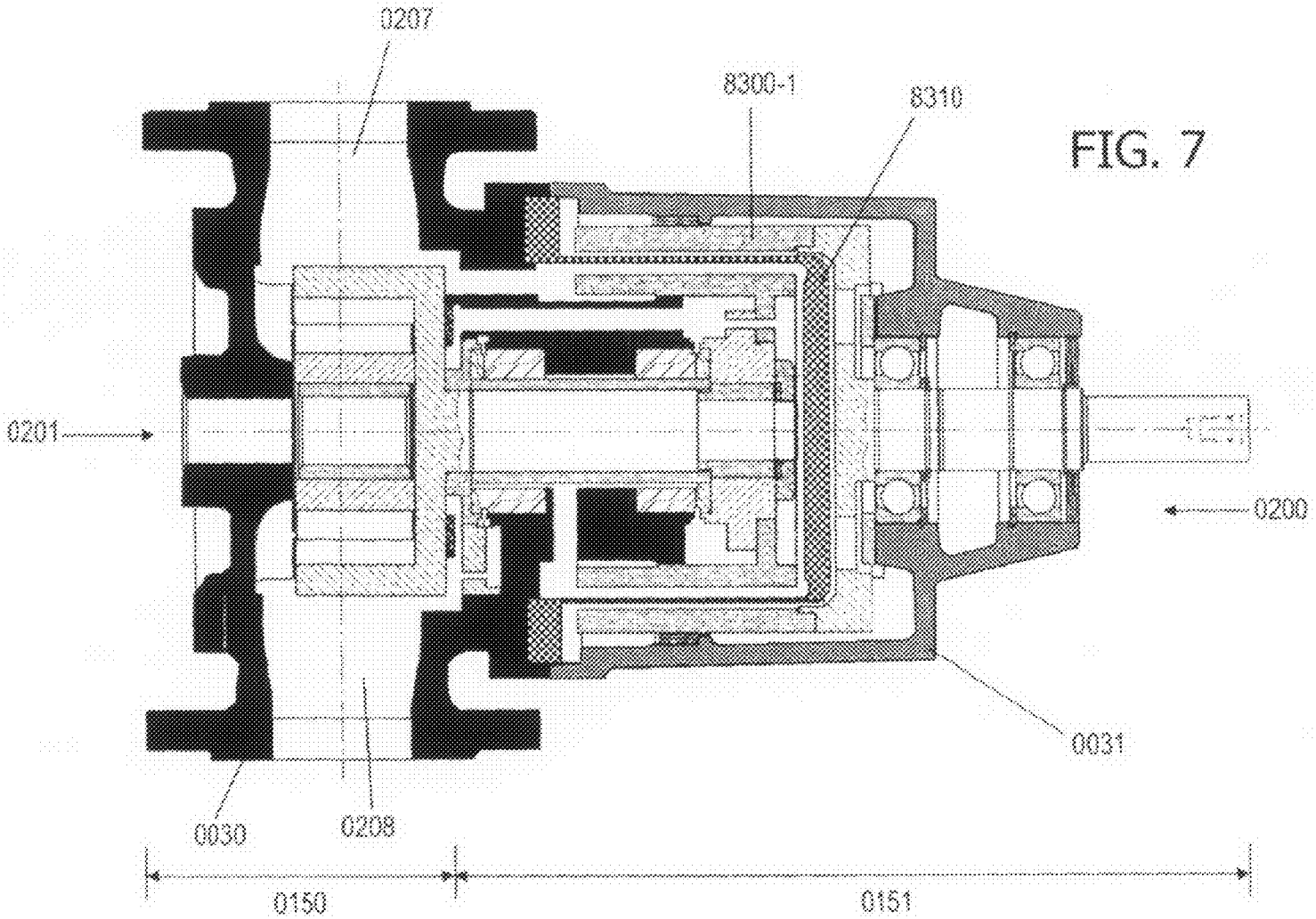

FIG. 7: A cross-sectional view of an embodiment of a pump of the invention as in FIG. 5 whereby the casing components are indicated.

Figure 8:
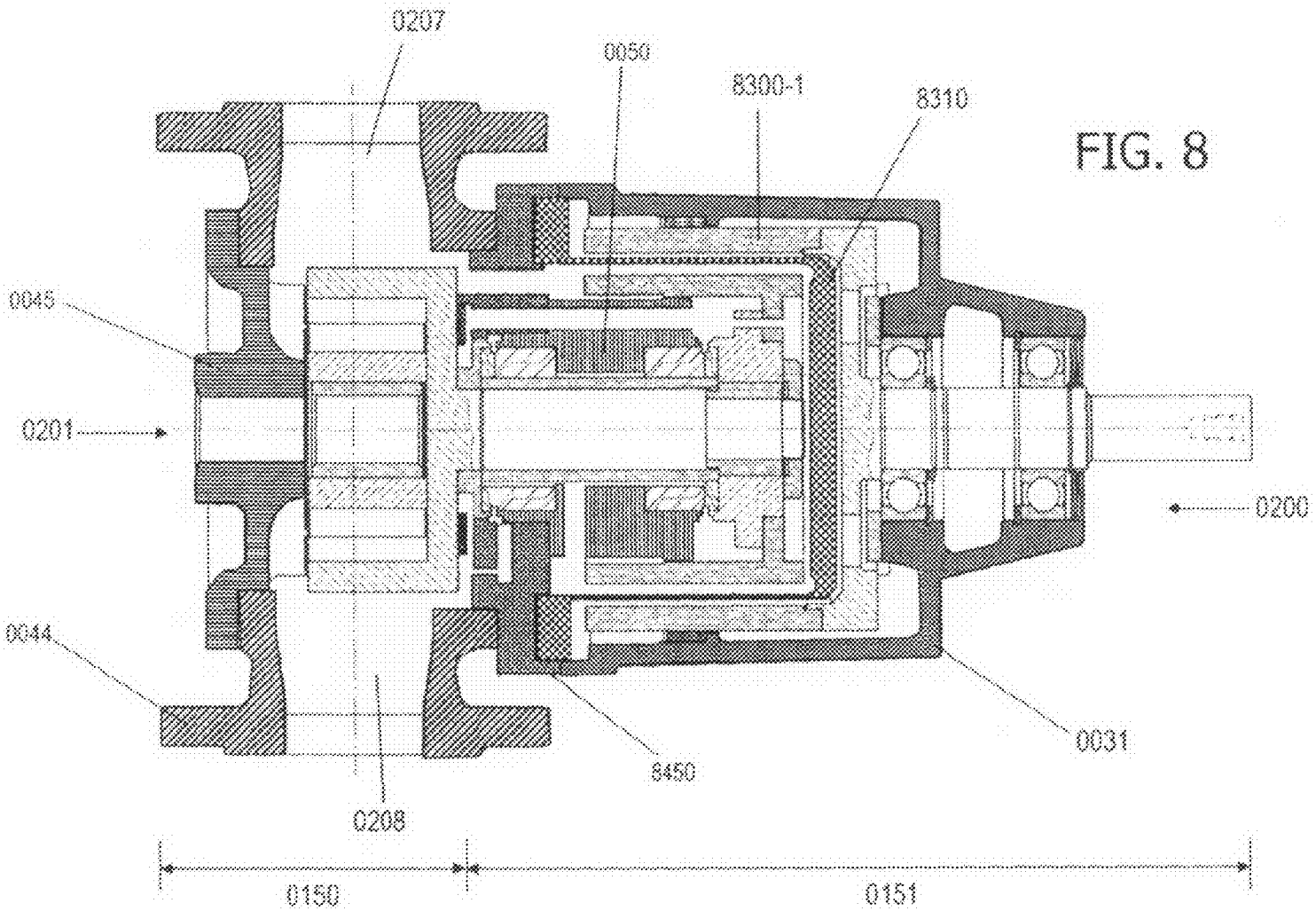

FIG. 8: A cross-sectional view of an embodiment of a pump of the invention as in FIG. 5 whereby the elements of the front casing are indicated.

DETAILED DESCRIPTION OF THE INVENTION

Unless defined otherwise, all technical and scientific terms used herein have the same meaning as is commonly understood by one of skill in the art. All publications referenced herein are incorporated by reference thereto. All United States patents and patent applications referenced herein are incorporated by reference herein in their entirety including the drawings.

The articles "a" and "an" are used herein to refer to one or to more than one, i.e. to at least one of the grammatical object of the article. By way of example, "a port" means one port or more than one port.

Throughout this application, the term "about" is used to indicate that a value includes the standard deviation of error for the device or method being employed to determine the value.

The recitation of numerical ranges by endpoints includes all integer numbers and, where appropriate, fractions subsumed within that range (e.g. 1 to 5 can include 1, 2, 3, 4 when referring to, for example, a number of ports, and can also include 1.5, 2, 2.75 and 3.80, when referring to, for example, measurements). The recitation of end points also includes the end point values themselves (e.g. from 1.0 to 5.0 includes both 1.0 and 5.0).

The present invention relates to an improvement to a rotary positive displacement pump with magnetic coupling, whereby the inventors achieve cooling not only by diverting pumped medium across the magnetic coupling and bearings, but by providing a separate rotary displacement pump (known here as a circulating pump) between the main pump and the magnetic coupling. This circulation pump forces a defined amount of liquid through the magnetic coupling, which amount is independent of the differential pressure of the main pump and the viscosity of the medium. Should the viscosity of the medium change during pumping, the present pump will maintain a constant flow rate across the bearings which permits an equal cooling effect from high viscous to low viscosity liquids without need for any regulating means.

The invention is applicable to all rotary positive displacement pumps so providing the requisite flow independent of the viscosity of the pumped medium. As mentioned earlier, examples of positive displacement pumps include internal gear pumps, external gear pumps, and rotary vane pumps. One particular group of rotary positive displacement pumps are internal gear pumps. These are well known in the art, and for completeness a brief description follows herein with reference to FIG. 1, which shows a pump of the present invention from the perspective of the main internal gear pump.

A magnetically coupled internal gear pump of the invention comprises two main sections adjacently aligned along a longitudinal axis 0160; these are the pumping section 0150 at the front or forward side 0201 of the pump which contains the moving parts for the suction and discharge of liquid, and a magnetic coupling section 0151 towards the rear or rearward side 0200 that comprises an outer (driving) magnetic and inner (driven) magnetic rotor whereby the inner magnetic rotor is mechanically attached to and drives the pump, and the outer magnetic rotor transmits externally applied rotational forces to the inner magnetic rotor. The inner magnetic rotor is sealed from the outer magnetic rotor by a separation can 8310. The magnetic coupling section 0151 also comprises a hub 8455, bearings 1400, 1401 and shaft 0702 for driving the outer magnetic rotor. The sections are housed in a rear casing 0031 which incorporates a bearing bracket 1405 at the rear end supporting the drive shaft 0702. The sections of the casing are described later below. Such pumps will typically have a suction side 0205, the side of the pump where liquid enters, and a discharge side 0206, the side of the pump where liquid is expelled.

The pumping section 0150 comprising a main internal gear pump (MP) which in the instant device is typical of the art. It comprises an MP rotor 0701 provided with a cylindrical cavity 0705 disposed with inwardly pointing teeth 0706, which MP rotor 0701 drives an idler 0600 situated inside the MP rotor 0701 cavity 0705 shown in inset FIG. 1A. The idler 0600 is supported by an idler pin 0610 mounted in a seating 0707 in the front casing 0030, particularly in the pump cover 0045, at the front end 0201 of the pump. The idler 0600 has gear teeth 0605 that engage with the MP rotor teeth in an eccentric arrangement, well known in the art. The idler 0600 and MP rotor 0701 may be made from any suitable material, including, for example, cast iron, alloy steel, or duplex stainless steel. The MP rotor 0701 is connected to and driven by a rotor shaft 0715 which extends towards the rear end 0200 of the pump, into the magnetic coupling section, and terminates within the separation can 8310.

As the MP rotor 0701 turns, the volume created by the idler 0600 and the MP rotor 0701 cavity 0705 increases on the suction (inlet) side 0205 of the pump where MP rotor 0701 and idler 0600 teeth un-mesh. As result of this increase in volume the pressure in the gear cavities decreases. The pumped medium, therefore, enters the main pump via the inlet port 0207, driven by the pressure difference between suction side 0205 and the pressure in the gear cavities. The medium fills the cavities between the teeth of both MP rotor 0701 and idler 0600 and is transported to the discharge (outlet) side 0206 of the pump, where it is expelled via the discharge port 0208. On the discharge side 0206 the medium is forced out from these cavities and pushed into the discharge line by the meshing gears. The gap between discharge 0206 and suction side 0205 of the pump is sealed by the crescent shaped portion 0606 which is fixed to the front casing 0030, particularly to the pump cover 0045. The sections of the casing are described later below.

Depending on the size and geometry of the pump hydraulic, the main pump displaces a certain amount of liquid per revolution of the shaft, so there is a direct relation between shaft speed and output capacity of the pump. In reality, the effective capacity is slightly lower than the theoretical capacity depending on the pressure difference between discharge side 0206 and suction side 0205 of the pump and the viscosity of the pumped medium.

This inefficiency is because part of the flow leaks back from the discharge 0206 to the suction 0205 side of the pump through the necessary gaps between the rotating and stationary parts of the pump.

An internal gear pump only displaces liquid, so the pressure on the discharge side 0206 of the pump depends on the system attached to the discharge port of the pump casing. A high discharge pressure can be caused by pressure losses in the discharge piping system, a static head, a system pressure or a combination of these.

The majority of internal gear pumps are equipped with a dynamic shaft seal at the point where the drive shaft enters the pump casing. Such seal may be, for example, a gland packing, lip seal or various types of mechanical seal. All dynamic shaft seals are prone to wear and leakage. The amount of leakage might be very small in case of mechanical seals. Dynamic shaft sealings require regular inspection and maintenance during their service life.

In case of pumping toxic media, or in general media where no leakage can be tolerated, an hermetically sealed pump is required. A magnetically coupled positive displacement pump fulfils these requirements. The hydraulic part of the pump is completely closed so the only openings are the inlet and outlet port of the pump casing. There are no dynamic seals; all components are sealed with static seals, such as gaskets and o-rings which are designed to be leak-free and to show no wear.

The magnetic coupling section 0151 of the pump is typical of an arrangement of the art, and comprises three main components (FIG. 1): an inner magnetic rotor 8300-2, an outer magnetic rotor 8300-1 co-axially aligned with the inner magnetic rotor and a separation can 8310 that covers the inner magnetic rotor 8300-2. Magnetic forces between permanent magnets disposed on the inner and outer magnetic rotors induce a rotation of the inner magnetic rotor 8300-2 when the outer magnetic rotor 8300-1 turns. The inner magnetic rotor 8300-2 is attached to a hub 8205 on the rotor shaft 0715, which shaft is supported by plain bearings 8359 that is part of the front casing 0030, in particular of the bearing casing 0050. The sections of the casing are described later below. These part of the inner magnetic rotor are submerged in the pumped medium, and is liquid-sealed from the outer magnetic rotor by the separation can 8310.

The plane bearing 8359 comprises the rotating rotor shaft 0715 supported by a stationary cylindrical portion of the front casing 0030, particularly in the bearing casing 0050. Typically the bearing is located in the magnetic coupling section 0151. According to a preferred embodiment of the invention, the plain bearing 8359 comprises a rotating shaft sleeve 8350, supported by two bearing bushes 8354, 8355 disposed towards the longitudinal ends of the sleeve and two axial bearing rings 8352, 8353 (FIG. 5).

The shaft sleeve 8350 is disposed coaxially over the rotor shaft 0715 and is attached thereto; thus the shaft sleeve 8350 rotates in concert with the rotor shaft 0715. The shaft sleeve 8350 is preferably supported by two ring-shaped bearing bushes 8354, 8355, preferably one (8354) located at the rearward 0200 end and one (8355) at the forward 0201 end of the shaft sleeve 8350. The rearward 0200 end of the shaft sleeve 8350 may be defined as the region that extends from the rear end of the shaft sleeve 8350 and towards its front end, by 4%, 5%, 6%, 7%, 8%, 9%, 10%, 30%, 33%, preferably by 5 to 30% of the longitudinal length of the shaft sleeve 8350. The forward end of the shaft sleeve 8350 may be defined as the region that extends from the forward end of the shaft sleeve 8350 and towards its rear end, by 4%, 5%, 6%, 7%, 8%, 9%, 10%, 30%, 33%, preferably by 5 to 30% of the longitudinal length of the shaft sleeve 8350. The bearing bushes 8354, 8355 are in an essentially co-axial relation to the shaft sleeve 8350, and are stationary, being bedded in the bearing casing 0050.

The bearing bushes may be flanked by two axial bearing rings 8352 and 8353, one connected to the rearward 0200 end of the shaft sleeve 8350 and one connected to the forward 0201 end of the shaft sleeve 8350. The axial bearing rings 8352, 8353 are in an essentially co-axial relation to the shaft sleeve 8350, and are attached thereto; thus the axial bearing rings 8352, 8353 rotate in concert with the shaft sleeve 8350. In practice, the forward axial bearing ring 8353 may be integrated in the drive gear 8410 of the circulating pump 8410 and the rearward axial bearing ring 8352 may be integrated in the hub 8205 of the inner magnetic rotor 8300-2.

The forward axial bearing ring 8353 acts as axial bearing against the front end-face of the forward bearing bush 8355 and the rearward axial bearing rings 8353 acts as axial bearing against the rear end-face of the rearward bearing bushes 8354. They support and position the rotor of the main pump 0701 and the inner magnetic rotor 8300-2 in an axial direction. The bearing bushes 8354 and 8355 are supported in the pump casing, particularly the bearing casing 0050. The rotating shaft sleeve 8350 running inside the cylindrical bores of bearing bushes 8354 and 8355 support the rotor shaft 0715 radially.

The outer magnetic rotor 8300-1 is assembled on a pump (driven) shaft 0702, which is supported by roller bearings 1400, 1401 mounted in a bearing bracket 1405 at the rear end of the pump. The outer magnetic rotor 8300-1 is positioned concentrically over the inner magnetic rotor 8300-2. The separation can 8310 seals the rear 0200 end of the hydraulic part of the pump hermetically between inner and outer magnetic rotor. Permanent magnets are fixed in pairs of north and south poles on the outer circumference of the inner magnetic rotor 8300-2 and the inner circumference of the outer magnetic rotor 8300-1. The magnets on the inner magnetic rotor 8300-2 are encapsulated in stainless steel to protect them against the pumped medium, while the magnets on the outer magnetic rotor 8300-1 which are not in contact with the medium are not covered.

When the outer magnetic rotor 8300-1 rotates, the magnetic fields of the outer magnets engage through the separation can with the magnets mounted on the inner magnetic rotor 8300-2 and drives the rotor shaft 0715. The torque transmission between pump shaft 0702 and rotor shaft 0715 is realized without physical connection between these two components, thus no dynamic sealing of the pump (driven) shaft 0702 is required.

The plane bearings 8359 and the inner rotor 8300-2 of the magnetic coupling are submerged in the liquid which is pumped by the internal gear pump. Due to hydraulic friction inside the plane bearings 8359 and the gaps between rotating and stationary parts of the magnetic coupling, heat is generated during operation. To prevent unpermissable high temperatures inside the bearings 8359 and the magnetic coupling a cooling system must be foreseen.

To achieve this, the pump's flow is partly redirected from the discharge side 0206 of the pump through the magnetic coupling section and the plane bearings back to the suction side 0205 of the pump. At the suction side 0205 of the pump the heated medium passing from the coupling is mixed with fresh, cold medium which is entering the pump. The effect of the cooling depends on the amount of liquid passing through the coupling. To generate a flow through the coupling the friction losses inside the coupling must be overcome. The higher the viscosity of the medium, the higher is the required pressure difference between inlet and outlet of the magnetic coupling to ensure a sufficient flow. If the pressure difference between suction and discharge port of the pump would be used to generate a flow through the coupling, the flow would strongly varying in function of the differential pressure and the viscosity of the medium.

As mentioned above, the improvement to the positive displacement pump lies in an integrated positive displacement circulation pump, attached to and driven by the inner magnetic rotor. The circulation pump is integrated in the pump casing and is driven by the same rotor shaft as the main pump. If the main pump runs at high speed, friction inside the magnetic coupling and thus also the heat generated is higher than at low shaft speed. Since the circulation pump is directly driven by the pump shaft the capacity of the circulation pump changes with the speed of the pump shaft, so the output flow of the circulation pump is adapted to the cooling requirement.

The circulation pump is designed as a positive displacement pump working according to the same principle as the main pump. The following description is relevant to an internal gear pump, though the skilled person would understand it can be applied any rotary positive displacement pump according to the principles described herein. A three dimensional view of an embodiment of the present invention is shown in FIG. 2, from the perspective of the circulation pump. An exploded view of the circulation pump is shown in FIG. 3, an assembled view given in FIG. 4 and a cross-sectional view of the entire pump with integrated circulation pump is given in FIG. 5.

In FIG. 2, a circulation pump (CP) rotor 8420 is visible (dotted region), having an axis of rotation parallel with the axis of rotation of the rotor shaft 0715; being eccentrically arranged, however, the axis of rotation of the CP rotor 8420 is not aligned with the axis of rotation of the rotor shaft 0715. The CP rotor 8420 comprises a flat disc, with a hollow centre disposed with inwardly pointing teeth 8421, which CP rotor 8420 is driven by a CP drive gear 8410 (not shown) situated within the hollow centre of CP rotor 8420.

A view of the circulation pump from the front 0201 is shown in FIG. 4, which depicts the CP drive gear 8410 within the hollow of the CP rotor 8420. The CP drive gear 8410 has gear teeth 8411 that engage with the CP rotor teeth 8421 in an eccentric arrangement.

FIG. 3 shows the constituents of the circulation pump 8470 in an exploded view. The CP drive gear 8410 is shown housed in a cylindrical pump insert 8430 (FIG. 4) which is accommodated by an longitudinal cylindrical cavity that extends from the front casing 0030, preferably from the intermediate cover 8450. The rotation axis of the CP drive gear 8410 is aligned with the rotation axis of the main pump (MP) rotor shaft 0715. The CP drive gear 8410 is normally connected with the MP rotor shaft 0715, both turning in concert. The pump insert 8430 is disposed with a longitudinal cylindrical chamber 8415 in which the CP rotor 8420 lies, the periphery of the rotor being supported by the cylindrical chamber 8415 which allows rotation of the CP rotor 8420. The CP drive gear 8410 drives rotor 8420, which contains the outer tooth profiles.

As the CP drive gear 8410 rotates, the volume created by the CP drive gear 8410 and the CP rotor 8420 hollow increases on an suction 1010 (inlet) side of the circulation pump where CP drive gear 8410 and CP rotor 8420 teeth un-mesh. As result of this increase in volume the pressure in the gear cavities decreases. The medium, therefore, enters the circulation pump via a suction (inlet) port 1011 on the suction side 1010, partly driven by the pressure difference between suction side 1010 and the pressure in the gear cavities. The medium fills the cavities between the teeth of both CP drive gear 8410 and CP rotor 8420 and is transported to the discharge (outlet) side 1015 of the circulation pump. On a discharge side 1015 the medium is forced out from these cavities and pushed into the discharge port 1016 by the meshing gears. The gap between discharge 1015 and suction side 1010 of the pump is sealed by the crescent shaped portion 8419 which is fixed to the cylindrical pump insert 8430 and does not rotate.

The width (distance from the front (0201) side to the rear (0200) side) of the CP rotor 8420 is smaller than the width of the CP drive gear 8410, so the liquid can enter from the rear side of the CP rotor 8420 and fill the tooth cavities of the drive gear 8410 and the disk rotor 8420. According to one embodiment of the invention, the width of the CP rotor 8420 is at least 10%, 20%, 30%, 40%, 50%, 60%, 70% less than the width of the CP drive gear 8410, preferably it is at least 50%.

The inlet port 1011 of the circulation pump is connected via a passageway to the outlet port 0208 of the main pump. According to one embodiment, the inlet port 1011 of the circulation pump is connected via a halfmoon shaped chamber 0105 (FIG. 4) in the front casing 0030 (preferably the pump casing 0040) with the discharge (outlet) side 0206 of the main pump. Because the inlet to the circulation pump is at the discharge side of the main pump, circulation is pushed into, rather than sucked into the circulation pump. The outlet port 1016 of the circulation pump is connected via a passageway through the magnetic coupling and bearings to the inlet port 0207 of the main pump.

The liquid displacement of the main pump per revolution preferably is greater than that of the circulation pump. According to one aspect of the invention, the displacement of the circulation pump is equal to or greater than 0.5%, 1%, 1.5%, 2%, 2.5%, 3%, 3.5%, 4%, 4.5%, 5% of that of the main pump, preferably between 1.5% and 3.5%.

While the gear pumps in the present figures are arranged so that the main pump uses an outer driven rotor and the circulation pump uses an inner driven gear, any combination of outer driven rotor or inner driven gear for the main and circulation pumps is contemplated by the invention.

The components of the pump section 0150 and magnetic coupling section 0151 are supported by a pump casing. The casing may be cast from a single element, however, typically it is composed from several element joined together for example by bolts and/or rivets. The casing may comprise two distinct regions—a front section 0030 and a rear section 0031. FIG. 7 shows by means of shaded areas, said front 0300 and rear sections 0031. The front casing 0030 (black shading) supports and encloses the moving parts of the pumping section 0150 and the parts enclosed by the separation can 8310 (large chequered shading). Typically the front casing supports and encloses what is commonly known as "wet parts" of the pump. The front casing 0030 is provided with passageways that form the inlet 0207 and outlet 0208 to the pump. The front casing 0030 extends into the magnetic coupling section 0151 and within the separation can 8310, where it serves to support the (plane) bearings for the inner magnetic rotor 8300-2, and is provided with a plurality of cooling bores and passageways. The front casing may comprise an element that is a pump insert 8430 (FIG. 2), attached to the front casing that serves to support the components of the circulation pump. The front casing 0030 may also comprise an element that is an intermediate cover 8450 (FIG. 2) to which the rear casing 0031 is bolted. The rear casing 0031 (small chequered shading) accommodates a bearing bracket for support of the outer magnetic rotor 8300-1 and may extend forward to cover part of the magnetic coupling section 0151, in particular the outer magnetic rotor 8300-1. Typically the rear casing 0031 supports and encloses what is commonly known as "dry parts" of the pump.

As mentioned above, the front casing 0030 may comprise separate elements which are joined, for example by bolts or rivets to form a rigid structure. An exemplary composition is shown in FIG. 8, where front casing elements are shown shaded in grey. The front casing may comprising a pump casing 0044 (diagonal line shading) that houses the inlet 0207 and outlet 0208 ports, the MP rotor 0701 and idler 0600. Attached towards the forward end 0201 may be a pump cover 0045 (horizontal line shading) which supports the idler and seals the forward end of the pump casing 0044. Attached to the pump casing 0044, towards the rearward end 0200 may be an intermediate cover 8450 (confetti shading) which supports the CP rotor 8420 and drive gear 8410 and covers the rearward end of the pump casing 0044. Attached to the rearward end 0200 of the intermediate cover 8450 is a bearing casing 0050 (vertical line shading) which supports the plane bearing 8359.

The casing may be made form any suitable material such as stainless steel, cast iron, or titanium which the skilled person would be able choose based on the requirement e.g. corrosion resistance, economy.

As mentioned above, part of the pumped medium is transported in the tooth cavities from the suction 1010 to the discharge 1015 side of the circulation pump. At the discharge side 1015 it is forced by the meshing gears into the discharge port 1016 which also leads to cooling passages in the casing present in magnetic drive section 0151 of the pump.

An exemplary arrangement of cooling circulation passages is shown in FIG. 6 where arrows indicate the direction of flow of the pumped medium. Medium exiting 8605 from the discharge side 1015 of the circulation pump (shown by a "0"), passes along a longitudinal supply passage 8600 in the (front) casing 0030, which supply passage 8600 runs in a direction towards the rear 0200 of the pump. The supply passage 8600 opens into a rearward annular passageway (RAP) 8610 located towards the rear 0200 of the magnetic coupling section 0151. Said RAP 8610 is a circular passage concentrically arranged around the rearward end of the rotor shaft 0715. In particular, it is concentrically disposed over the rearward end 0200 of the plane bearing 8359. The rearward end of the plane bearing 8359 may be defined as the region that extends from the rear end of the plane bearing and towards its front end, by 4%, 5%, 6%, 7%, 8%, 9%, 10%, 30%, 33%, 40%, 50%, 60%, 67%, or 70%, preferably by 5 to 20% of the longitudinal length of the plane bearing.

Preferably, the RAP 8610 is disposed over the interface between the rearward 0200 bearing bush 8354 and the rearward 0200 axial bearing ring 8352.

A concentric ring chamber 8660 connects the RAP 8610 with the rearward end 0200 of the plane bearing 8359, in particular, with the interface between the rearward 0200 bearing bush 8354 and the rearward 0200 axial bearing ring 8352.

According to one aspect of the invention, the front end-face of the rearward bearing bush 8354 is disposed with one or more radial grooves. Thus, medium may pass from the RAP and through the rearward bearing bush 8354 and to the sleeve 8350. These radial grooves are narrower in dimension than the apertures 8665 in the hub 8205 in order to limit the flow across the plain bearing 8359.

The RAP 8610 is also in connection with the inner magnetic rotor hub 8205 to which the inner magnetic rotor 8300-2 is attached. In other words, a front face of said hub 8205 forms a boundary of the RAP 8610. Thus medium may pass from the RAP 8610 to the front surface of the inner magnetic rotor hub 8205. Said hub 8205 is provided with a plurality of apertures 8665 running in a longitudinal direction from the front to the rear side of the hub 8205. Said apertures 8665 are most preferably disposed in a circle around the hub 8205 as shown in FIGS. 1 and 2. Thus, medium is able to pass from the front to the rear side of the hub 8205 and to the interior wall of the separation can 8310. Once at the interior wall of the separation can 8310, medium can pass across the gap 8620 between the inner magnetic rotor 8300-2 and the separation can 8310. It is indicated on the cross-sectional representation of FIG. 6 that medium exiting the inner magnetic rotor hub aperture 8665 passes entirely around the rear face of the hub, the space 8666, 8667 ("1" in FIG. 6) at the rear end of the inner magnetic rotor hub.

From the foregoing, it can be ascertained that medium passes from the RAP 8610 and splits in two directions—across the plane bearing 8630 and across the gap 8620 between the inner magnet and the separation can. Medium returning from both routes is collected by a front annular passage (FAP) 8640 present in the front casing 0030, particularly in the bearing casing 0050, located towards the front 0201 of the magnetic coupling section 0151. Said front annular passage (FAP) 8640 is a circular passage concentrically arranged around the rotor shaft 0715. In particular, it is concentrically disposed over the plane bearing 8359, in a position that is juxtaposed longitudinally forwards 0201 of the RAP 8610. According to one aspect of the invention, the FAP 8640 is disposed in a region that extends from the RAP 8610 forwards 0201 by 10%, 20%, 30%, 33%, 40%, 50%, 60%, 67%, or 70%, preferably by 50 to 70% of the longitudinal length of the plane bearing. Preferably, the RAP 8610 lies from the forward end by distance that is at least 1% of the longitudinal length of the plane bearing.

According to another aspect of the invention, the FAP 8640 is concentrically disposed over a central part of the plane bearing 8359. The central part of the plane bearing 8359 may be defined as the region that extends in both the forwards and rearwards directions from an imaginary line equidistant from the ends of the plane bearing, 30%, 33%, 40%, 50%, 60%, 67%, or 70%, preferably by 30 to 40% of the longitudinal length of the plane bearing.

One or more radial passages 8625 connect the FAP 8610 with the plane bearing 8359, in particular, with the shaft sleeve 8350. The FAP 8640 is also in connection with the front edge of the inner magnetic rotor 8300-2. In other words the front end of the inner magnetic rotor 8300-2 forms a boundary wall of the FAP 8640. Thus medium may pass from the gap 8620 between the inner magnetic rotor 8300-2 and the separation can 8310, in a forward direction, towards the (FAP) 8640. The FAP 8640 connects via an exit passage 8650 to the inlet 0207 of the main pump. FIG. 4 shows the front end of the exit passage E is connected via a channel 8340 to a halfmoon shaped chamber 0115 in the rotor case 0010, which halfmoon shaped chamber 0115 is connected with the inlet 0207 of the main pump.

As mentioned elsewhere, the flow of the main pump is partly redirected from the discharge side 0206 of the pump through the magnetic coupling and the plane bearings back to the suction side 0205 of the pump. FIG. 6 details an example of this arrangement; a diversion passage 8615 connects the discharge port 0208 of the main pump with the forward end of the plane bearing 8359, in particular, with the forward bearing bush 8353.

The forward end of the plane bearing 8359 may be defined as the region that extends from the forward end of the plane bearing and towards its rear end, by 30%, 33%, 40%, 50%, 60%, 67%, or 70%, preferably by 30 to 40% of the longitudinal length of the plane bearing.

In particular, the diversion passage 8615 connects with the forward end of the plane bearing 8359 in a position that is juxtaposed longitudinally forwards 0201 of the FAP 8640. According to one aspect of the invention, the diversion passage 8615 connects with the plane bearing 8359 in a region that extends from the FAP 8640 forwards 0201 by 10%, 20%, 30%, 33%, 40%, 50%, 60%, 67%, or 70%, preferably by 30 to 40% of the longitudinal length of the plane bearing. Preferably, the diversion passage 8615 lies from the forward end by distance that is at least 1% to 10% of the longitudinal length of the plane bearing.

Preferably a concentric ring chamber 8670 connects the diversion passage 8615 with the forward end 0201 of the plane bearing 8359, in particular, with the interface between the forward 0201 bearing bush 8355 and the forward 0201 axial bearing ring 8353.

Thus, medium passes across the bearing in a backwards direction from the diversion passage 8615, and exits at the FAP 8640 located towards the centre of the plane bearing 8359.

Medium passing across the plane bearing 8351 will flow in the space between the sleeve and the bearing casing 0050/bearing bushes 8352, 8353. The present invention advantageously maintains a lower operating temperature even for viscous medium. Since more viscous fluid provides a better lubricating film, and as a medium is more viscous at lower temperatures, the present invention reduces wear across the plane bearing compared with pumps of the art having less efficient cooling. Thereby, maintenance costs are also reduced.

At the suction side 0205 of the pump the heated medium passing from the coupling is mixed with fresh, cold medium which is entering the pump. The effect of the cooling depends on the amount of liquid passing through the coupling. To generate a flow through the coupling, the friction losses inside the coupling must be overcome. The higher the viscosity of the medium, the higher is the required pressure difference between inlet and outlet of the magnetic coupling to ensure a sufficient flow. If the pressure difference between suction and discharge port of the pump would be used to generate a flow through the coupling, the flow would strongly varying in function of the differential pressure and the viscosity of the medium.

What is claimed is:

1. A pump for liquid medium, comprising:

a pump casing containing:

a forward pumping section having an inlet and an outlet, and a rearward magnetic coupling section having an inner magnetic rotor and outer magnetic rotor separated by a separation can, which outer magnetic rotor transmits rotation via magnetic coupling to the inner magnetic rotor, a main pump in the pumping section that is a rotarty positive displacement pump that provides suction through the inlet and discharges through the outlet, whereby the main pump is mechanically connected to a rotor shaft mounted in a plane bearing, which shaft is connected to the inner magnetic rotor, a circulation pump in the pumping section configured to cool the plane bearing and magnetic coupling, wherein the circulation pump is a rotary positive displacement pump mechanically connected to said rotor shaft;

a rearward annular passageway, RAP, concentrically arranged over a rearward end of the plane bearing and whereby a forward face of the hub of the inner magnetic rotor forms a boundary surface of the RAP, a concentric ring chamber connects the RAP with the rearward end of the plane bearing, a longitudinal supply passage in the casing running from outlet of the circulation pump towards said hub, whereby the longitudinal supply passage opens into said (RAP); and a plurality of apertures in said hub running in a longitudinal direction from the forward to the rearward face of the hub, said arrangement allowing medium from the outlet of the circulation pump to flow across the plane bearing and across a gap between the separation can and inner magnetic rotor.

2. The pump according to claim 1, wherein the circulation pump comprises an inlet port connected to the outlet of the main pump via a liquid-conducting passage.

3. The pump according to claim 1, wherein the casing comprises a plurality of liquid-conducting passages for conducting medium to the plane bearing and inner magnetic rotor, and whereby an outlet of the circulation pump is connected to said conducting passages.

4. The pump according to claim 1, wherein the main pump and the circulation pumps are gear pumps.

5. The pump according to claim 4, wherein the main gear pump comprises a rotor and an idler, whereby the rotor is mechanically connected to the rotor shaft.

6. The pump according to claim 4, wherein the circulation gear pump comprises a rotor and a drive gear, whereby the drive gear is mechanically connected to the rotor shaft.

7. The pump according to claim 4, wherein the axes of rotation of the main pump rotor, the circulation pump drive gear, the inner magnetic coupling, and the rotor shaft are coaxial.

8. The pump according to claim 1, wherein the plane bearing comprises a shaft sleeve in connection with the shaft, supported buy two bearing bushes flanked by two axial bearing rings, the concentric ring chamber connects the RAP with the interface between a rearward bearing bush and a rearward axial bearing ring.

9. The pump according to claim 1, further comprising, a forward annular passageway, FAP, concentrically arranged over a central section of the plane bearing and whereby a front end of the inner magnetic rotor forms a boundary surface of the FAP, and one or more radial passages connect the FAP with the central section of the plane bearing, a longitudinal exit passage in the casing running from the FAP to the inlet of the main pump, said arrangement allowing medium returning from the plane bearing and from the gap between the separation can and inner magnetic rotor to exit via the inlet of the main pump.

10. The pump according to claim 9, further comprising a diversion passage in the casing that connects the outlet port of the main pump with the forward end of the plane bearing, said passage allowing medium to flow from the outlet port of the main pump to flow across the from the plane bearing and to exit via the FAP.

11. The pump according to claim 10, further comprising a forward concentric ring chamber that connects the diversion passage with the forward end of the plane bearing.

12. The pump according to claim 11, wherein the plane bearing comprises a shaft sleeve in connection with the shaft, supported by two bearing bushes flanked by two axial bearing rings, the concentric ring chamber connects the diversion passage with the interface between a forward bearing bush and a forward axial bearing ring.

* * * * *